US011105341B2

(12) United States Patent
Avedon

(10) Patent No.: US 11,105,341 B2
(45) **Date of Patent: *Aug. 31, 2021**

(54) AIR MOVING DEVICE

(71) Applicant: AIRIUS IP HOLDINGS, LLC, Longmont, CO (US)

(72) Inventor: Raymond B. Avedon, Boulder, CO (US)

(73) Assignee: AIRIUS IP HOLDINGS, LLC, Longmont, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/694,567

(22) Filed: Nov. 25, 2019

(65) Prior Publication Data

US 2020/0166053 A1 May 28, 2020

Related U.S. Application Data

(63) Continuation of application No. 15/417,102, filed on Jan. 26, 2017, now Pat. No. 10,487,852.
(Continued)

(51) Int. Cl.
*F04D 25/08* (2006.01)
*F04D 29/64* (2006.01)
*F04D 29/60* (2006.01)

(52) U.S. Cl.
CPC ..... *F04D 29/601* (2013.01); *F04D 25/088* (2013.01); *F04D 29/646* (2013.01)

(58) Field of Classification Search
CPC ..... F04D 29/601; F04D 29/646; F04D 25/088
See application file for complete search history.

(56) References Cited

U.S. PATENT DOCUMENTS 651,637 A * 6/1900 Nicol ..... F16B 21/088 403/71
D33,522 S 11/1900 Brinkerhoff
(Continued)

FOREIGN PATENT DOCUMENTS

AU 2013203632 11/2016
CN 1426729 7/2003
(Continued)

OTHER PUBLICATIONS

"The New Airius Q50 EC", https://web.archive.org/web/20150721185407/http://airius.com.au/technical/specification-sheets/the-new-airius-q50-ec/ as archived Jul. 21, 2015, pp. 2.
(Continued)

*Primary Examiner* — Kenneth Bomberg
*Assistant Examiner* — Brian Christopher Delrue
(74) *Attorney, Agent, or Firm* — Knobbe, Martens, Olson & Bear LLP

(57) ABSTRACT

An air moving device according to the present disclosure can include a housing and an installation hub. The housing can be connected to the installation hub via one or more adjustable supports. An impeller can be installed at least partially in the housing and configured to direct air out of the housing. In some embodiments, the adjustable supports can be adjusted to move the housing with respect to the installation hub. For example, the adjustable supports can be configured to modify the tilt of the housing and/or the overall distance between the housing and the installation hub. The installation hub can be installed on a ceiling, wall, or other mounting surface. Adjustment of the adjustable supports can permit vertical alignment of the air moving device housing, even when the installation hub is mounted to a slanted or sloped (e.g., non-horizontal) ceiling or wall.

19 Claims, 12 Drawing Sheets

Related U.S. Application Data

(60) Provisional application No. 62/354,531, filed on Jun. 24, 2016.

(56) References Cited

U.S. PATENT DOCUMENTS 818,604 A * 4/1906 Bierd ..... A63B 69/205 482/87
866,292 A 9/1907 Meston
917,206 A 4/1909 Watts
1,858,067 A 5/1932 Warren
1,877,347 A * 9/1932 McMurdie ..... F04D 29/281 416/186 R
1,926,795 A 9/1933 Sassenberg
2,016,778 A 10/1935 Hall et al.
2,142,307 A * 1/1939 De Mey ..... F04D 29/646 417/423.15
2,144,035 A 1/1939 Smith, Jr.
2,154,313 A 4/1939 McMahan
2,189,008 A 2/1940 Kurth
2,189,502 A 2/1940 Johnston
2,232,573 A 2/1941 Teves
2,258,731 A 10/1941 Blumenthal
D133,120 S 7/1942 Spear
2,300,574 A 11/1942 Jepertinger
2,359,021 A 9/1944 Campbell et al.
2,366,773 A 1/1945 Eklund et al.
2,371,821 A 3/1945 Havis
D152,397 S 1/1949 Damond
2,513,463 A 7/1950 Eklund et al.
2,524,974 A 10/1950 Hickmott
2,615,620 A 10/1952 Goettl
2,632,375 A 3/1953 Stair et al.
2,658,719 A 11/1953 Johanson
D174,230 S 3/1955 Lewis, II
2,710,337 A * 6/1955 Moore, Jr. ..... F21V 17/00 362/266
2,814,433 A 11/1957 Brinen
2,830,523 A 4/1958 Vehige
D187,699 S 4/1960 van Rijn
2,982,198 A 5/1961 Mohrman
3,012,494 A 12/1961 Drummond
3,036,509 A 5/1962 Babbitt
3,040,993 A 6/1962 Schultz
3,068,341 A 12/1962 Ortiz et al.
3,072,321 A * 1/1963 King, Jr. ..... D01H 11/005 415/70
D195,287 S 5/1963 Downing
3,099,949 A 8/1963 Davidson
3,165,294 A 1/1965 Anderson
3,188,007 A 6/1965 Myklebust
3,212,425 A 10/1965 Lindner et al.
3,246,699 A 4/1966 Jocz
3,300,123 A 1/1967 Freyholdt et al.
3,306,179 A 2/1967 Lambie et al.
3,320,869 A 5/1967 Schach
3,364,839 A 1/1968 Sweeney et al.
3,382,791 A 5/1968 Henry-Biabaud
3,386,368 A 6/1968 Fielding
3,413,905 A 12/1968 Johnson
3,524,399 A 8/1970 Bohanon
3,584,968 A 6/1971 Keith
3,601,184 A 8/1971 Hauville
3,690,244 A 9/1972 Kallel et al.
3,699,872 A 10/1972 Kruger
3,765,317 A 10/1973 Lowe
3,785,271 A 1/1974 Joy
3,827,342 A 8/1974 Hughes
D232,831 S 9/1974 Vidmar, Jr.
3,835,759 A 9/1974 Lloyd
D234,847 S 4/1975 Hoffman
3,876,331 A 4/1975 DenHerder et al.
3,927,300 A 12/1975 Wada et al.
3,932,054 A 1/1976 McKelvey
3,934,494 A 1/1976 Butler
3,967,927 A 7/1976 Patterson
3,973,479 A 8/1976 Whiteley
3,988,973 A 11/1976 Honmann
4,006,673 A 2/1977 Meyer et al.
D246,467 S 11/1977 Kurata
4,064,427 A * 12/1977 Hansen ..... F21S 8/065 362/96
4,123,197 A * 10/1978 Keem ..... F04D 25/10 188/82.3
D251,851 S 5/1979 Palm
4,152,973 A * 5/1979 Peterson ..... F24F 7/065 454/231
4,162,779 A * 7/1979 Van Steenhoven ..... F21V 21/03 248/343
4,185,545 A 1/1980 Rusth et al.
D255,488 S 6/1980 Kanarek
4,210,833 A 7/1980 Neveux
D256,273 S 8/1980 Townsend et al.
4,234,916 A * 11/1980 Goralnik ..... F21S 8/04 248/343
D258,010 S 1/1981 Bowls et al.
D258,526 S 3/1981 Nederman
4,261,255 A 4/1981 Anderson et al.
4,321,659 A 3/1982 Wheeler
4,344,112 A 8/1982 Brown
D269,638 S 7/1983 Frye, Jr. et al.
4,391,570 A * 7/1983 Stutzman ..... F04D 25/088 417/353
4,396,352 A 8/1983 Pearce
D272,184 S 1/1984 Karpowicz
D273,793 S 5/1984 Nachatelo
D274,772 S 7/1984 Obland
4,473,000 A * 9/1984 Perkins ..... F04D 25/088 454/299
4,512,242 A 4/1985 Bohanon, Sr.
4,515,538 A 5/1985 Shih
4,522,255 A 6/1985 Baker
4,524,679 A 6/1985 Lyons
4,546,420 A 10/1985 Wheeler et al.
4,548,548 A 10/1985 Gray, III
4,550,649 A 11/1985 Zambolin
D283,054 S 3/1986 Altman
4,630,182 A 12/1986 Moroi et al.
4,657,483 A 4/1987 Bede
4,657,485 A * 4/1987 Hartwig ..... F04D 29/703 362/96
4,662,912 A 5/1987 Perkins
4,678,410 A 7/1987 Kullen
4,681,024 A 7/1987 Ivey
4,692,091 A 9/1987 Ritenour
D293,029 S 12/1987 Shwisha
4,714,230 A * 12/1987 Huang ..... F04D 25/088 248/343
4,715,784 A 12/1987 Mosiewicz
4,716,818 A 1/1988 Brown
4,730,551 A 3/1988 Peludat
4,750,863 A * 6/1988 Scoggins ..... F04D 29/703 416/146 R
4,790,863 A 12/1988 Nobiraki et al.
4,794,851 A 1/1989 Kurrle
4,796,343 A 1/1989 Wing
4,848,669 A 7/1989 George
4,850,265 A 7/1989 Raisanen
4,890,547 A 1/1990 Wagner et al.
4,895,065 A 1/1990 Lamparter
D308,416 S 6/1990 Brumbach
4,930,987 A 6/1990 Stahl
4,971,143 A 11/1990 Hogan
4,973,016 A 11/1990 Hertenstein
D312,875 S 12/1990 Spock
D314,619 S 2/1991 Beavers et al.
5,000,081 A 3/1991 Gilmer
5,021,932 A 6/1991 Ivey
5,033,711 A 7/1991 Gregorich et al.
5,042,366 A 8/1991 Panetski et al.
5,060,901 A * 10/1991 Lathrop ..... F24F 7/013 248/343
5,078,574 A 1/1992 Olsen

(56) References Cited

U.S. PATENT DOCUMENTS 5,094,676 A * 3/1992 Karbacher ..... B01D 50/00 416/146 R
D325,628 S 4/1992 Cho
5,107,755 A 4/1992 Leban et al.
5,121,675 A 6/1992 Muller et al.
5,127,876 A 7/1992 Howe et al.
D328,405 S 8/1992 Heiligenstein et al.
5,152,606 A 10/1992 Borraccia et al.
5,156,568 A 10/1992 Ricci
5,191,618 A 3/1993 Hisey
D335,532 S 5/1993 Lopez
D337,157 S 7/1993 Ortiz
D340,765 S 10/1993 Joss et al.
5,251,461 A 10/1993 Fellows, III et al.
D347,467 S 5/1994 Medvick
5,328,152 A 7/1994 Castle
5,358,443 A 10/1994 Mitchell et al.
5,399,119 A 3/1995 Birk et al.
5,423,660 A 6/1995 Sortor
5,429,481 A 7/1995 Liu
5,439,349 A 8/1995 Kupferberg
5,439,352 A * 8/1995 Line ..... F04D 25/08 416/170 R
5,443,625 A 8/1995 Schaffhausen
5,458,505 A 10/1995 Prager
5,462,484 A 10/1995 Jung et al.
5,466,120 A 11/1995 Takeuchi et al.
5,484,076 A * 1/1996 Petrushka ..... H02G 3/125 220/3.9
5,511,942 A 4/1996 Meier
5,513,953 A * 5/1996 Hansen ..... F04D 25/088 415/183
5,520,515 A 5/1996 Bailey et al.
5,545,241 A 8/1996 Vanderauwera et al.
5,547,343 A 8/1996 Jané et al.
5,551,841 A 9/1996 Kamada
5,561,952 A * 10/1996 Damron ..... E04D 13/0325 454/199
5,569,019 A 10/1996 Katariya et al.
5,584,656 A 12/1996 Rose
5,595,068 A 1/1997 Amr
5,613,833 A 3/1997 Wolfe et al.
5,658,196 A 8/1997 Swaim
5,664,872 A 9/1997 Spearman et al.
D386,267 S 11/1997 Tickner
5,709,458 A 1/1998 Metz
5,725,190 A * 3/1998 Cuthbertson ..... F04D 25/088 248/317
5,725,356 A 3/1998 Carter
5,782,438 A * 7/1998 Hubben ..... H02B 1/048 248/27.3
5,791,985 A 8/1998 Schiedegger et al.
5,822,186 A 10/1998 Bull
D404,617 S 1/1999 Mick et al.
D407,696 S 4/1999 Shimazu
5,918,972 A 7/1999 Van Belle
5,934,783 A 8/1999 Yoshikawa
5,938,527 A 8/1999 Oshima et al.
D414,550 S 9/1999 Bloom
5,947,816 A 9/1999 Schiedegger et al.
5,967,891 A 10/1999 Riley et al.
5,975,853 A * 11/1999 Lackey ..... F04D 25/088 248/343
5,984,252 A * 11/1999 Bograng ..... H05K 7/16 248/317
5,997,253 A 12/1999 Fechan
6,004,097 A 12/1999 Wark et al.
6,068,385 A 5/2000 Hsieh
D427,673 S 7/2000 Stout, Jr.
6,095,671 A 8/2000 Hutain
6,109,874 A 8/2000 Steiner
6,145,798 A 11/2000 Janisse et al.
6,149,513 A 11/2000 Lyu
6,155,782 A * 12/2000 Hsu ..... F04D 25/084 415/126
6,168,517 B1 1/2001 Cook
6,176,680 B1 1/2001 Ringblom et al.
6,183,203 B1 2/2001 Grintz
6,192,702 B1 2/2001 Shimogori
6,193,384 B1 * 2/2001 Stein ..... F04D 25/088 362/812
6,196,915 B1 3/2001 Schiedegger et al.
D443,053 S 5/2001 Schaefer
6,319,304 B1 * 11/2001 Moredock ..... B01D 45/12 55/385.3
D453,960 S 2/2002 Shelby et al.
6,352,473 B1 3/2002 Clark
6,357,714 B1 * 3/2002 Johnson ..... F04D 25/088 248/343
6,360,816 B1 3/2002 Wagner
6,361,428 B1 3/2002 Tosconi et al.
6,361,431 B1 3/2002 Kawano
6,364,760 B1 4/2002 Rooney
D457,142 S 5/2002 Chang
D457,452 S 5/2002 Christiansen
D457,613 S 5/2002 Schaefer
6,382,911 B1 5/2002 Beltowski
6,383,072 B2 5/2002 Schiedegger et al.
6,384,494 B1 5/2002 Avidano et al.
6,386,828 B1 * 5/2002 Davis ..... A01K 1/0052 415/147
6,386,970 B1 5/2002 Vernier, II et al.
6,386,972 B1 5/2002 Schiedegger et al.
6,435,964 B1 8/2002 Chang
6,451,080 B1 9/2002 Rocklitz et al.
6,458,028 B2 * 10/2002 Snyder ..... F04D 25/088 454/292
6,458,628 B1 10/2002 Distefano et al.
6,484,524 B1 11/2002 Ulanov
D470,066 S 2/2003 Christiansen
D470,731 S 2/2003 Hipgrave et al.
6,551,185 B1 4/2003 Miyake et al.
6,575,011 B1 6/2003 Busby et al.
6,581,974 B1 6/2003 Ragner et al.
6,582,291 B2 6/2003 Clark
6,592,328 B1 7/2003 Cahill
6,595,747 B2 7/2003 Bos
D480,132 S 9/2003 Stout, Jr.
6,626,003 B1 9/2003 Kortum et al.
6,626,636 B2 9/2003 Bohn
D481,101 S 10/2003 Boehrs et al.
D481,127 S 10/2003 Hayamizu
D481,159 S 10/2003 Walker
6,648,752 B2 11/2003 Vernier, II et al.
6,679,433 B2 1/2004 Gordon et al.
6,682,308 B1 1/2004 Fei et al.
6,700,266 B2 * 3/2004 Winkel ..... F04D 25/08 310/112
D489,967 S 5/2004 Funk
6,761,531 B2 7/2004 Toye
6,767,281 B2 7/2004 McKee
6,783,578 B2 8/2004 Tillman, Jr.
6,804,627 B1 10/2004 Marokhovsky et al.
6,805,627 B2 10/2004 Marts et al.
6,812,849 B1 11/2004 Ancel
D500,773 S 1/2005 Colson et al.
D505,627 S 5/2005 Py et al.
6,886,270 B2 5/2005 Gilmer
6,916,240 B1 7/2005 Morton
6,938,631 B2 9/2005 Gridley
6,941,698 B2 * 9/2005 Telles ..... A47G 7/047 211/117
6,951,081 B2 10/2005 Bonshor
6,966,830 B2 11/2005 Hurlstone et al.
6,974,381 B1 12/2005 Walker et al.
D514,688 S 2/2006 Avedon
7,011,500 B2 3/2006 Matson
7,011,578 B1 * 3/2006 Core ..... F24F 7/007 454/292
7,044,849 B2 * 5/2006 Dippel ..... B60H 1/3407 454/143

(56) References Cited

U.S. PATENT DOCUMENTS 7,048,499 B2 5/2006 Mathson et al.
7,056,092 B2 6/2006 Stahl
7,056,368 B2 6/2006 Moredock et al.
D525,725 S 7/2006 Foo
7,101,064 B2 9/2006 Ancel
D532,229 S 11/2006 Hoernig et al.
7,152,425 B2 12/2006 Han et al.
7,166,023 B2 1/2007 Haigh et al.
7,175,309 B2 2/2007 Craw et al.
7,185,504 B2 3/2007 Kasai et al.
7,201,110 B1 4/2007 Pawlak
7,201,650 B2 4/2007 Demerath et al.
7,214,035 B2 5/2007 Bussieres et al.
7,246,997 B2 7/2007 Liu et al.
D552,485 S 10/2007 Grabiner et al.
7,287,738 B2 * 10/2007 Pitlor ..... H02G 3/20 248/205.4
7,288,023 B2 10/2007 Leopold
D557,791 S 12/2007 Cox
7,311,492 B2 12/2007 Östberg
7,320,636 B2 * 1/2008 Seliger ..... B08B 15/002 126/299 F
7,331,764 B1 2/2008 Reynolds et al.
D564,120 S 3/2008 Layne et al.
D567,930 S 4/2008 Smith
D567,961 S 4/2008 Yajima
7,374,408 B2 5/2008 Savage et al.
D570,981 S 6/2008 McClelland
7,381,129 B2 * 6/2008 Avedon ..... F04D 25/088 454/230
D578,390 S 10/2008 Green
D582,502 S 12/2008 Brittingham
D583,451 S 12/2008 Aloe et al.
D583,452 S 12/2008 Aloe et al.
7,467,931 B2 * 12/2008 O'Toole ..... F04D 25/088 415/220
D584,786 S 1/2009 Brittingham
7,473,074 B2 1/2009 Herbst et al.
7,476,079 B2 1/2009 Bartlett
7,484,863 B1 2/2009 Aubrey
7,497,773 B1 3/2009 Schmidt
D591,382 S 4/2009 Brittingham
7,516,578 B2 4/2009 Bonshor
7,544,124 B2 6/2009 Polston
7,549,258 B2 6/2009 Lajewski
7,566,034 B2 7/2009 Bonshor
D599,471 S 9/2009 Borovicka et al.
D600,396 S 9/2009 Luinstra
7,607,935 B2 10/2009 Dahl
D604,880 S 11/2009 Lovegrove
7,610,717 B2 * 11/2009 Luken ..... A01G 9/021 24/457
7,610,726 B2 11/2009 Lajewski
D605,332 S 12/2009 Miranda
7,645,188 B1 1/2010 Peerbolt
7,651,390 B1 1/2010 Profeta et al.
D612,925 S 3/2010 Kameyama et al.
7,677,770 B2 3/2010 Mazzochette
7,677,964 B1 3/2010 Bucher et al.
7,708,625 B2 5/2010 Leseman et al.
7,717,674 B2 * 5/2010 Tsuji ..... F04D 29/005 416/5
D617,890 S 6/2010 Thomas
D620,096 S 7/2010 Underwood
7,748,954 B2 7/2010 Eguchi et al.
7,752,814 B2 7/2010 Bonshor
D621,985 S 8/2010 Sanoner
D622,895 S 8/2010 Lyons
7,774,999 B2 8/2010 McKee
7,780,510 B2 8/2010 Polston
7,785,064 B2 8/2010 Bartholmey et al.
D625,855 S 10/2010 Franklin
D625,856 S 10/2010 Franklin
7,849,644 B2 12/2010 Melesky
D630,337 S 1/2011 Chia et al.
D630,536 S 1/2011 Pettit
D631,142 S 1/2011 Angell
D631,148 S 1/2011 Benton et al.
D631,579 S 1/2011 Franklin
D631,580 S 1/2011 Franklin
D631,581 S 1/2011 Franklin
7,901,278 B2 3/2011 O'Hagin
7,930,858 B2 4/2011 Lajewski
7,942,627 B2 5/2011 Jin
D645,550 S 9/2011 Ferroni
D645,561 S 9/2011 Herrmann et al.
D645,593 S 9/2011 Janssen
8,052,386 B1 11/2011 Fitzpatrick et al.
D651,709 S 1/2012 Zeyfang
D651,919 S 1/2012 Lai et al.
D651,920 S 1/2012 Lai et al.
D661,902 S 6/2012 Italiano
8,215,789 B2 7/2012 Howard
8,282,138 B2 10/2012 Steiner
8,297,945 B2 10/2012 Spaggiari
D672,863 S 12/2012 Romero Carreras
D676,877 S 2/2013 Drenth et al.
1,053,025 A1 2/2013 Goodwin
8,366,387 B2 * 2/2013 Reuter ..... F04D 29/601 415/220
D678,791 S 3/2013 Ford
D681,184 S 4/2013 Romero Carreras
D684,307 S 6/2013 Teller
8,459,846 B2 6/2013 Tsao
8,487,517 B2 7/2013 Fang et al.
8,529,324 B2 9/2013 Moredock et al.
8,535,128 B2 9/2013 Chwala
8,596,596 B2 12/2013 Naji et al.
8,616,842 B2 * 12/2013 Avedon ..... F04D 25/088 415/209.2
D698,916 S 2/2014 Avedon
8,641,375 B2 2/2014 Tian et al.
D702,887 S 4/2014 Peiruccelli
D703,302 S 4/2014 Ruck
D703,579 S 4/2014 Kuster et al.
D709,643 S 7/2014 Kohler et al.
D710,485 S 8/2014 Nudo
D710,490 S 8/2014 Shurtleff
D711,843 S 8/2014 Yamazaki et al.
D714,996 S * 10/2014 Trotter ..... D26/140
D715,904 S * 10/2014 Tate ..... D23/414
8,894,354 B2 11/2014 Hodgson et al.
8,899,930 B2 12/2014 Innocenti et al.
D721,645 S 1/2015 Brown
8,931,936 B1 * 1/2015 Tham ..... F21V 21/38 362/404
D722,486 S 2/2015 Wang
D724,199 S 3/2015 Bambot et al.
D725,053 S 3/2015 Kaneko et al.
D725,055 S 3/2015 Yamazaki et al.
8,967,983 B2 * 3/2015 Kampf ..... F04D 29/545 417/360
8,992,174 B2 3/2015 Chang
D730,185 S 5/2015 Blanco et al.
9,028,085 B2 * 5/2015 Todd, Jr. ..... F04D 29/00 362/93
9,028,211 B2 * 5/2015 Todd, Jr. ..... F04D 29/582 416/5
D731,030 S 6/2015 Tyler
D733,555 S 7/2015 Brady et al.
D739,223 S 9/2015 Paik et al.
D739,515 S 9/2015 Johnson et al.
D739,832 S 9/2015 Yamazaki et al.
D740,973 S 10/2015 Gonzalez
9,151,295 B2 10/2015 Avedon
D742,508 S 11/2015 Row et al.
D742,563 S 11/2015 Kasha
D743,521 S 11/2015 Jackson
D746,416 S 12/2015 Barlar
D746,971 S 1/2016 Avedon
D747,453 S 1/2016 Stewart et al.
D752,339 S 3/2016 Hoover
D753,817 S 4/2016 Maguire et al.

(56) References Cited

U.S. PATENT DOCUMENTS

D753,818 S 4/2016 Maguire et al.
D754,312 S 4/2016 Ellis
D755,438 S 5/2016 Kimmet
D756,494 S 5/2016 Gledhill et al.
D756,498 S 5/2016 Norman et al.
9,335,061 B2 5/2016 Avedon
D758,642 S 6/2016 Eguchi
D760,384 S 6/2016 Niunoya et al.
D761,419 S 7/2016 Fitzgerald et al.
D766,098 S 9/2016 Seo
D766,100 S 9/2016 Jung
D768,844 S 10/2016 Koseoglu
9,459,020 B2 10/2016 Avedon
D772,531 S 11/2016 Troia
D774,689 S 12/2016 Terumichi
D775,719 S 1/2017 Smith et al.
D777,311 S 1/2017 Chen
D783,795 S 4/2017 Avedon
9,631,627 B2 4/2017 Avedon
D788,886 S 6/2017 Balzer
D788,953 S 6/2017 Khan
9,696,026 B1 * 7/2017 Hardgrave ..... F24F 8/10
9,702,576 B2 7/2017 Avedon
9,714,663 B1 7/2017 Avedon
D794,198 S 8/2017 Mizumura et al.
D794,199 S 8/2017 Mizumura et al.
D798,718 S 10/2017 Foster et al.
D799,014 S 10/2017 Suarez et al.
D799,675 S 10/2017 Wong
D800,174 S 10/2017 Ghalsasi et al.
D801,510 S 10/2017 O'Connell et al.
D801,545 S 10/2017 Wiesli et al.
D803,381 S 11/2017 Kim et al.
D805,176 S * 12/2017 Avedon ..... D23/379
D818,185 S 5/2018 Wilson
9,970,457 B2 5/2018 Avedon
D820,967 S 6/2018 Avedon
10,024,531 B2 7/2018 Avedon
D824,716 S 8/2018 Elgamil et al.
D825,090 S * 8/2018 Richardson ..... D26/84
D831,484 S 10/2018 Jung et al.
D835,265 S 12/2018 Inoue
D836,238 S 12/2018 Ericson, Jr. et al.
D838,379 S 1/2019 Trump
10,184,489 B2 * 1/2019 Avedon ..... F04D 29/545
D840,009 S 2/2019 Suarez et al.
D841,452 S 2/2019 Conselvan
D844,126 S 3/2019 Sheng et al.
D844,128 S 3/2019 Li
10,221,861 B2 * 3/2019 Avedon ..... F04D 13/06
D845,461 S 4/2019 Li
D845,462 S 4/2019 Li
D847,967 S 5/2019 Hernández et al.
D848,295 S 5/2019 Johnson et al.
D850,727 S 6/2019 Petruccelli
D852,143 S 6/2019 Ku
D853,017 S 7/2019 Rioux et al.
D861,979 S 10/2019 Sibley
D862,795 S 10/2019 Caldas
D865,223 S 10/2019 Spork et al.
D865,907 S 11/2019 Wagner
D868,254 S 11/2019 Lintula et al.
10,487,840 B2 11/2019 Avedon
10,487,852 B2 * 11/2019 Avedon ..... F04D 29/601
D869,275 S 12/2019 Taunk
D870,778 S 12/2019 Johnson
D871,535 S 12/2019 Ferrer
D872,911 S 1/2020 Chen
D877,917 S 3/2020 Schill
D880,098 S 3/2020 Harrison et al.
D881,374 S 4/2020 Schoettle
D885,550 S 5/2020 Avedon
10,641,506 B2 5/2020 Avedon
10,655,841 B2 5/2020 Avedon
D886,275 S 6/2020 Avedon
D887,541 S 6/2020 Avedon
10,724,542 B2 7/2020 Avedon
11,053,948 B2 7/2021 Avedon
2001/0049927 A1 12/2001 Toepel
2002/0045420 A1 4/2002 Taillon
2002/0131865 A1 9/2002 Larzelere et al.
2002/0137454 A1 9/2002 Baker
2003/0026691 A1 2/2003 Huang et al.
2003/0092373 A1 5/2003 Kuo
2003/0213883 A1 * 11/2003 Fu-Liang ..... F04D 29/601 248/343
2004/0004173 A1 * 1/2004 Johnson ..... F04D 25/088 248/343
2004/0050077 A1 3/2004 Kasai et al.
2004/0052641 A1 3/2004 Chen
2004/0240214 A1 12/2004 Whitlow et al.
2004/0253095 A1 12/2004 Sasaki et al.
2005/0045793 A1 * 3/2005 Johnson ..... F04D 29/601 248/343
2005/0077446 A1 * 4/2005 Bacon ..... F04D 29/601 248/343
2005/0092888 A1 5/2005 Gonce
2005/0159101 A1 7/2005 Hrdina et al.
2005/0202776 A1 9/2005 Avedon
2006/0087810 A1 4/2006 Rockenfeller
2006/0146542 A1 7/2006 Sullivan
2006/0172688 A1 * 8/2006 Johnson ..... F04D 29/384 454/254
2006/0193139 A1 8/2006 Sun et al.
2006/0276123 A1 12/2006 Sanagi et al.
2006/0278766 A1 * 12/2006 Wang ..... F04D 25/088 248/74.1
2006/0284435 A1 12/2006 Vitito
2007/0213003 A1 9/2007 Railkar et al.
2007/0231145 A1 * 10/2007 Jin ..... F04D 19/02 416/198 R
2007/0246579 A1 10/2007 Blateri
2007/0297906 A1 12/2007 Wu
2007/0297912 A1 12/2007 Reuter
2008/0019836 A1 1/2008 Butz et al.
2008/0061200 A1 * 3/2008 Bouissiere ..... F16M 13/02 248/206.5
2008/0188175 A1 8/2008 Wilkins
2008/0227381 A1 * 9/2008 Avedon ..... F04D 29/601 454/230
2009/0041580 A1 2/2009 Wichmann et al.
2009/0122516 A1 5/2009 Yang
2009/0155080 A1 6/2009 Yu
2009/0170421 A1 7/2009 Adrian et al.
2009/0219727 A1 9/2009 Weaver
2009/0262550 A1 10/2009 Inoue
2010/0009621 A1 1/2010 Hsieh
2010/0052495 A1 3/2010 Liu et al.
2010/0075588 A1 3/2010 Haneline
2010/0111698 A1 * 5/2010 Wiedeman ..... F04D 29/60 416/189
2010/0176706 A1 7/2010 Fu et al.
2010/0192611 A1 8/2010 Yamaguchi et al.
2010/0202932 A1 8/2010 Danville
2010/0232168 A1 9/2010 Horng
2010/0266400 A1 10/2010 Avedon
2010/0295436 A1 11/2010 Horng et al.
2010/0328881 A1 12/2010 Huang
2010/0329885 A1 * 12/2010 Criner ..... F04D 29/601 416/244 R
2011/0037368 A1 2/2011 Huang
2011/0057551 A1 3/2011 Lee et al.
2011/0057552 A1 3/2011 Weaver
2011/0080096 A1 4/2011 Dudik et al.
2011/0084586 A1 4/2011 Lain et al.
2011/0133622 A1 6/2011 Mo et al.
2011/0140588 A1 6/2011 Chen
2011/0223016 A1 * 9/2011 Ediger ..... F04D 25/08 415/213.1
2011/0228967 A1 * 9/2011 Kulchy ..... F16M 11/08 381/394
2012/0060453 A1 3/2012 Holzmann et al.
2012/0062095 A1 3/2012 Horng

(56) References Cited

U.S. PATENT DOCUMENTS

| | | | | |
|---|---|---|---|---|
| 2012/0194054 | A1 | 8/2012 | Johnston | |
| 2012/0195749 | A1* | 8/2012 | Avedon | B23P 19/00 415/211.2 |
| 2013/0011254 | A1 | 1/2013 | Avedon | |
| 2013/0027950 | A1 | 1/2013 | Avedon | |
| 2013/0111721 | A1* | 5/2013 | Mahfoudh | F04D 29/605 29/281.1 |
| 2013/0196588 | A1 | 8/2013 | Liao | |
| 2014/0314560 | A1 | 10/2014 | Avedon | |
| 2014/0348634 | A1* | 11/2014 | Bourrilhon | F04D 29/60 415/65 |
| 2015/0021013 | A1 | 1/2015 | Batarseh | |
| 2015/0176834 | A1* | 6/2015 | Avedon | F04D 25/088 415/121.3 |
| 2015/0354578 | A1* | 12/2015 | Avedon | F04D 25/08 417/53 |
| 2016/0107200 | A1 | 4/2016 | Al-Shafei et al. | |
| 2016/0146222 | A1* | 5/2016 | Avedon | F04D 19/002 415/211.2 |
| 2017/0370363 | A1 | 12/2017 | Avedon | |
| 2018/0149161 | A1 | 5/2018 | Avedon | |
| 2018/0149380 | A1 | 5/2018 | Avedon | |
| 2018/0335049 | A1* | 11/2018 | Gu | F04D 29/384 |
| 2019/0010961 | A1* | 1/2019 | Kumaou | B29C 66/65 |
| 2019/0011121 | A1 | 1/2019 | Avedon | |
| 2019/0285088 | A1 | 9/2019 | Avedon | |
| 2020/0217530 | A1 | 7/2020 | Avedon | |
| 2020/0333027 | A1 | 10/2020 | Avedon | |
| 2020/0378594 | A1 | 12/2020 | Avedon | |
| 2021/0062827 | A1 | 3/2021 | Avedon | |

FOREIGN PATENT DOCUMENTS

| | | | | |
|---|---|---|---|---|
| CN | 101592328 | | 12/2009 | |
| CN | 201560963 | | 8/2010 | |
| DE | 44 13 542 | | 10/1995 | |
| DE | 196 38 518 | | 4/1998 | |
| DE | 10 2008 04487 | | 3/2010 | |
| EP | 0 037 958 | | 10/1981 | |
| EP | 0 212 749 | | 3/1987 | |
| EP | 0 772 007 | | 5/1997 | |
| EP | 2 248 692 | | 11/2010 | |
| FR | 0 715 101 | | 11/1931 | |
| FR | 2 784 423 | | 4/2000 | |
| GB | 190617978 | | 5/1907 | |
| GB | 0 792 369 | | 3/1958 | |
| GB | 0 824 390 | | 11/1959 | |
| GB | 0 981 188 | | 1/1965 | |
| GB | 1 251 880 | | 11/1971 | |
| GB | 2 344 619 | | 6/2000 | |
| GB | 2 468 504 | | 9/2010 | |
| JP | 55-032965 | | 3/1980 | |
| JP | 61-502267 | | 10/1986 | |
| JP | 01-067548 | | 3/1989 | |
| JP | 07-167097 | | 7/1995 | |
| JP | 07-253231 | | 10/1995 | |
| JP | 08-219939 | | 8/1996 | |
| JP | 11-132543 | | 5/1999 | |
| JP | 2001-193979 | | 7/2001 | |
| JP | 2002-349489 | | 12/2002 | |
| JP | 2006-350237 | | 12/2006 | |
| JP | 2010-181124 | | 8/2010 | |
| KR | 20-0176664 | | 4/2000 | |
| KR | 2003-0025428 | | 3/2003 | |
| KR | 10-1255739 | | 4/2013 | |
| RU | 2400254 | C2 | 9/2010 | |
| TW | M337636 | | 8/2008 | |
| WO | WO 01/034983 | | 5/2001 | |
| WO | WO 03/040572 | | 5/2003 | |
| WO | WO-03040572 | A1 * | 5/2003 | F04D 29/601 |
| WO | WO 2005/091896 | | 10/2005 | |
| WO | WO 2006/078102 | | 7/2006 | |
| WO | WO 2008/062319 | | 5/2008 | |
| WO | WO 2010/046536 | | 4/2010 | |
| WO | WO 2010/114702 | | 10/2010 | |
| WO | WO 2011/067430 | | 6/2011 | |
| WO | WO 2012/174155 | | 12/2012 | |
| WO | WO 2012/174156 | | 12/2012 | |
| WO | WO 2015/187856 | | 12/2015 | |
| WO | WO 2016/081693 | | 5/2016 | |
| WO | WO 2020/214729 | | 10/2020 | |

OTHER PUBLICATIONS

"Airius Model R20 EC 'Eyeball' Data Sheet", http://airius.com.au/products/new-retail-series-2/attachment/na_std_retailseries/ published Jun. 15, 2016 as printed May 23, 2017 in 1 page.

Keeler Hardware, "OC Oval Cylinder Escutcheon", https://www.keelerhardware.com.au/products/oc-oval-cylinder-escutcheon as printed Nov. 13, 2017 in 3 pages.

* cited by examiner

AIR MOVING DEVICE

CROSS-REFERENCE TO RELATED APPLICATIONS

This application is a continuation of U.S. patent application Ser. No. 15/417,102, filed Jan. 26, 2017, which claims the benefit under 35 U.S.C. 119(e) to U.S. Provisional Patent Application No. 62/354,531, filed Jun. 24, 2016, the entire disclosure of which is hereby incorporated by reference herein in its entirety. Any and all priority claims identified in the Application Data Sheet, or any corrections thereto, are hereby incorporated by reference under 37 CFR 1.57.

TECHNICAL FIELD

Certain embodiments discussed herein relate to devices, methods, and systems for moving air that are particularly suitable for creating air temperature destratification within a room, building, or other structure.

DISCUSSION OF THE RELATED ART

Air moving devices are widely used to move air within enclosures. In some cases, the air moving devices are positioned at or near the ceiling of an enclosure to move warmer air from the vicinity of the ceiling toward the ground.

SUMMARY

An air moving device according to the present disclosure can include a housing and an installation hub. The housing can be connected to the installation hub via one or more adjustable supports. In some embodiments, the adjustable supports can be adjusted to move the housing with respect to the installation hub. For example, the adjustable supports can be configured to modify the tilt of the housing (e.g., the angle of the bottom of the housing with respect to horizontal) and/or the overall distance between the housing and the installation hub. The installation hub can be installed on a ceiling, wall, or other mounting surface. Adjustment of the adjustable supports can permit vertical alignment (e.g., alignment of the air moving device such an axis of rotation of the impeller is perpendicular to the ground and/or the air moving device directs air perpendicular to the floor) of the air moving device housing, even when the installation hub is mounted to a slanted or sloped (e.g., non-horizontal) ceiling or wall.

According to some embodiments, an air moving device comprises a housing having an upstream end and a downstream end. The device can include an impeller positioned at least partially within the housing. The impeller can be configured to direct air through the upstream end and out of the downstream end of the housing. In some embodiments, the device includes an installation mechanism configured to connect to a ceiling or wall of an enclosure. The device can include a tilt mechanism. The tilt mechanism can include a plurality of supports connected to the installation mechanism and to the housing. In some embodiments, at least one of the plurality of supports comprises an adjustable length. In some embodiments, the tilt mechanism is configured to tilt the housing when the adjustable length of one or more of the plurality of supports is adjusted.

In some configurations, the tilt mechanism comprises at least one track, the at least one track forming a guide surface for at least a portion of each of the plurality of supports.

In some configurations, the tilt mechanism comprises anchors connected to the plurality of supports, the anchors configured to releasably lock the plurality of supports in place with respect to the installation mechanism.

According to some embodiments, an air moving device includes a housing having an upstream end and a downstream end. The air moving device can include an impeller positioned at least partially within the housing and configured to direct air into the upstream end and out from the downstream end of the housing. In some embodiments, the air moving device includes a mount configured to connect to an installation site. The air moving device can include a plurality of flexible connectors connecting the housing to the mount. In some embodiments, each of the plurality of flexible connectors has a first end comprising an anchor and a second end connected to the housing. In some embodiments, the anchors are configured to adjustably mate with the mount in at least two mounting positions. In some embodiments, the second end of one of the plurality of flexible connectors is positioned closer to the mount when the anchor on the respective flexible connector is in a first mounting position than when the anchor of the respective flexible connector is in a second mounting position.

In some embodiments, each of the plurality of flexible connectors extends through an aperture in the mount.

In some embodiments, the mount is a circular plate.

In some embodiments, the mount includes a track, the track comprising at least one scalloped wall.

In some embodiments, the anchors are configured to releasably engage with indentations in the scalloped wall.

In some embodiments, the mount includes a track and a plurality of apertures extending through a lower surface of the mount into the track.

In some embodiments, the air moving device includes at least three flexible connectors.

According to some variants, an air moving device includes a destratifying assembly. The destratifying assembly can include a housing having a first end and a second end. In some embodiments, the destratifying assembly includes an impeller positioned within the housing between the first and second ends. The impeller can be configured to rotate about an impeller axis. In some embodiments, the destratifying assembly includes a light unit positioned on a side of the impeller opposite the first end of the housing. The air moving device can include a mount defining a surface for mating with an installation site. In some embodiments, the air moving device includes a plurality of flexible connectors connected to both the destratifying assembly and the mount. The plurality of flexible connectors can be configured to support the destratifying assembly. In some embodiments, each of the plurality of flexible supports is configured to permit a distance between (1) an intersection of the flexible connector and the mount and (2) an intersection of the flexible connector and the destratifying assembly to be varied.

In some embodiments, the air moving device includes a motor configured to selectively rotate the impeller. The motor can be positioned on a side of the impeller opposite the light unit.

In some embodiments, the light unit is positioned along the impeller axis.

In some embodiments, the air moving device includes a plurality of stator vanes positioned radially outward around the light unit with respect to the impeller axis between the light unit and a wall of the housing.

In some embodiments, the air moving device includes a plurality of stator blades positioned within the housing between the impeller and the light unit.

In some embodiments, one or more of the flexible connectors are configured to overlap one or more other flexible connectors within a track of the mount.

In some embodiments, the air moving device includes at least three flexible connectors.

According to some variants, an air moving device includes a housing having an upstream end and a downstream end. The air moving device can include an impeller positioned at least partially within the housing and configured to direct air through the upstream end and out of the downstream end of the housing. In some embodiments, the air moving device includes a mount configured to connect to a ceiling or wall of an enclosure. The air moving device can include a plurality of supports connected to the installation mechanism and to the housing. In some embodiments, at least one of the plurality of supports comprises an adjustable length. In some embodiments, the plurality of supports are configured to tilt the housing when the adjustable length of one or more of the plurality of supports is adjusted.

In some embodiments, the mount comprises at least one track, the at least one track forming a guide surface for at least a portion of each of the plurality of supports.

In some embodiments, at least one of the plurality of supports comprises an anchor configured to releasable lock the at least one of the plurality of supports in place with respect to the mount.

In some embodiments, each of the anchors is a cylinder.

In some embodiments, each of the anchors is a sphere.

In some embodiments, each of the plurality of supports is a flexible wire.

In some embodiments, the plurality of supports are configured to orient the housing in a plurality of tilted positions without the use of hinges.

In some embodiments, the plurality of supports are configured to tilt the housing about a plurality of axes of rotation with respect to the mount.

BRIEF DESCRIPTION OF THE DRAWINGS

The present disclosure is described with reference to the accompanying drawings, in which like reference characters reference like elements, and wherein.

DETAILED DESCRIPTION

Air circulation and/or destratification is often desirable within enclosures such as bedrooms, living rooms, bathrooms, and/or other indoor or partially indoor enclosures. Often, it is desirable to direct the flow of air from an air moving device in a substantially vertical direction (e.g., substantially perpendicular to the floor). Directing air perpendicular to the floor can reduce temperature stratification (e.g., perform destratification) within an enclosure by moving hotter air from the vicinity of the ceiling toward the cooler air in the vicinity of the floor. In some cases, in order to accomplish air circulation or destratification, it may be desirable to mount an air moving device on a slanted (e.g., non-horizontal) wall or ceiling. Installation on a sloped ceiling can introduce challenges with respect to tilting of the air moving device and with ceiling clearance. As such, there is a need for an air moving device that can be easily tilted to a desired trajectory. In some cases, there is a need for an air moving device that can be easily tilted and installed very close to a sloped ceiling or wall. Alternatively, in some cases it may be desirable to secure an air moving device to a horizontal ceiling, but to tilt the device such that the device moves air in a direction other than perpendicular to the floor.

Figure 1:
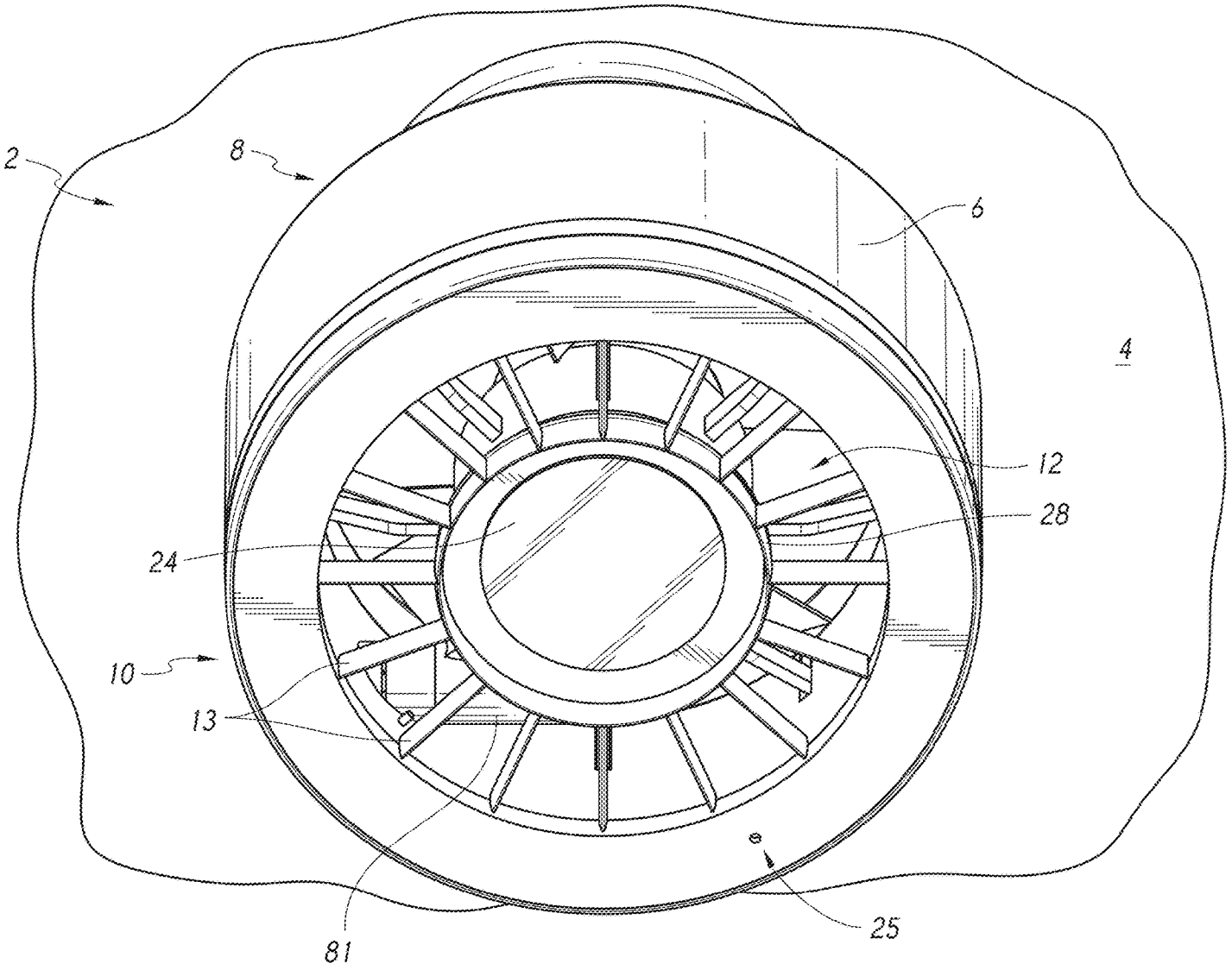
FIG. 1 is a bottom perspective view of an embodiment of an air moving device.
Figure 2A:
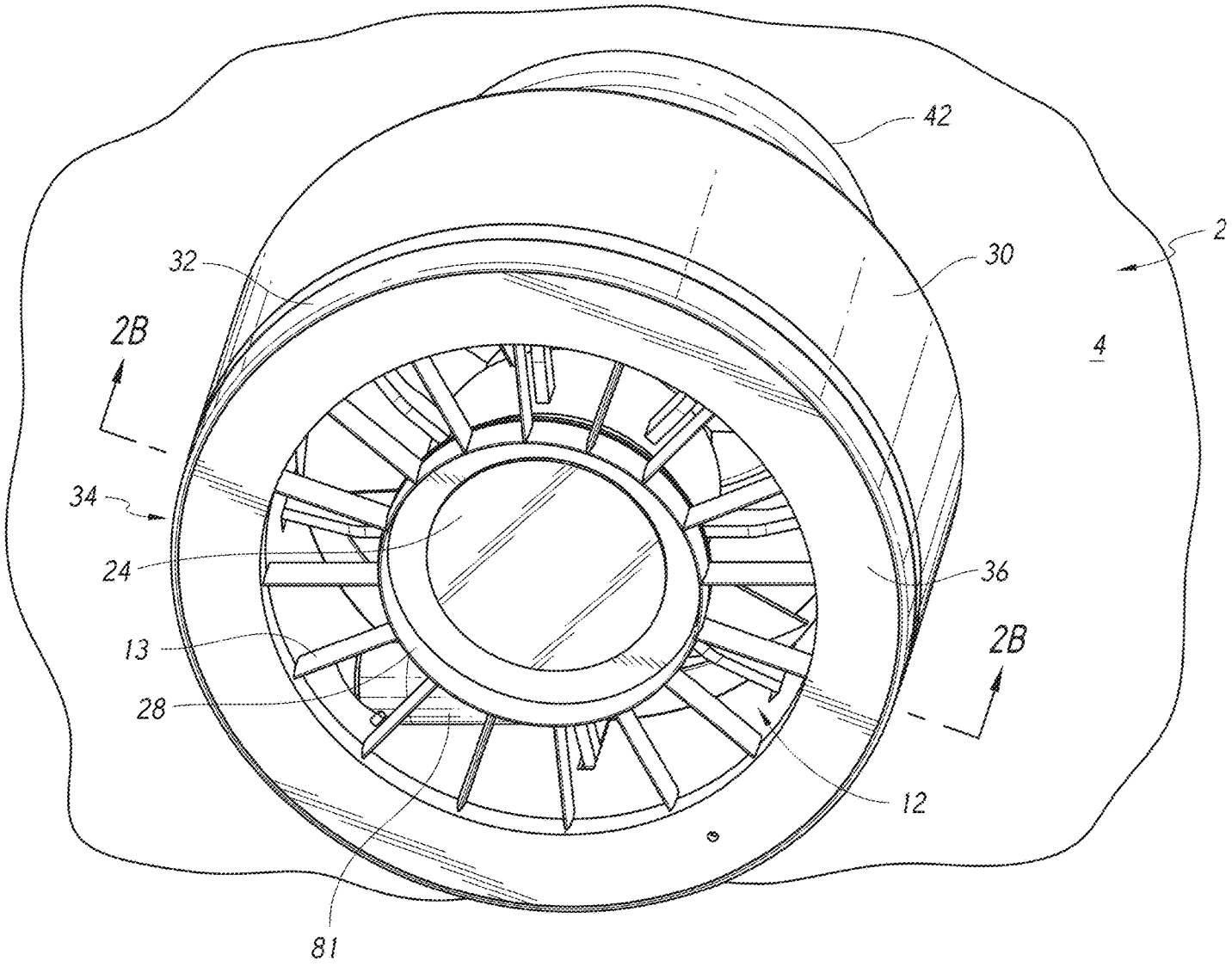
FIG. 2A is another bottom perspective view of the air moving device of FIG. 1.
Figure 2B:
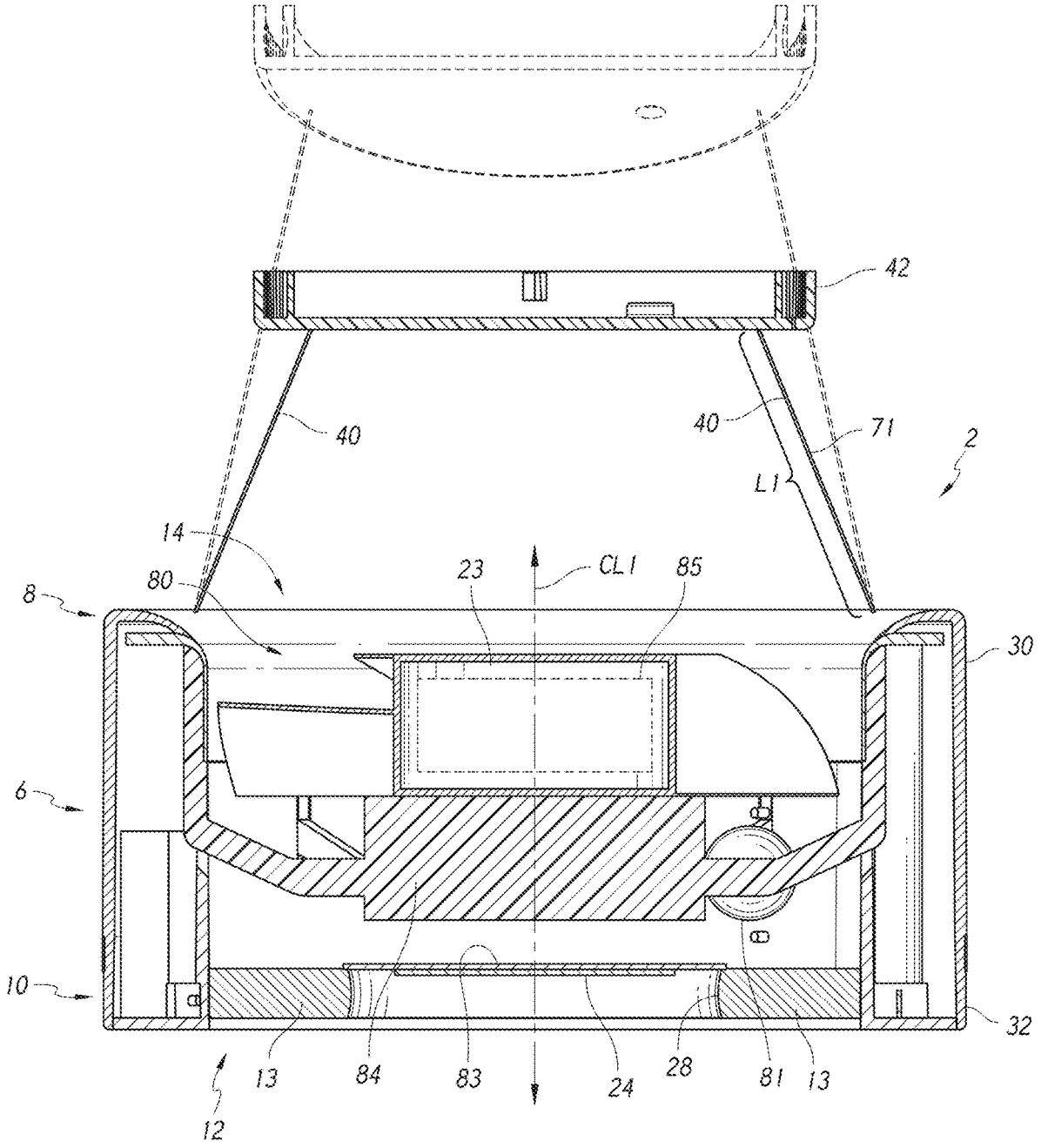
FIG. 2B is a cross-sectional view of the air moving device of FIG. 1 as viewed along the cut plane 2B-2B of FIG. 2A.
Figure 3:
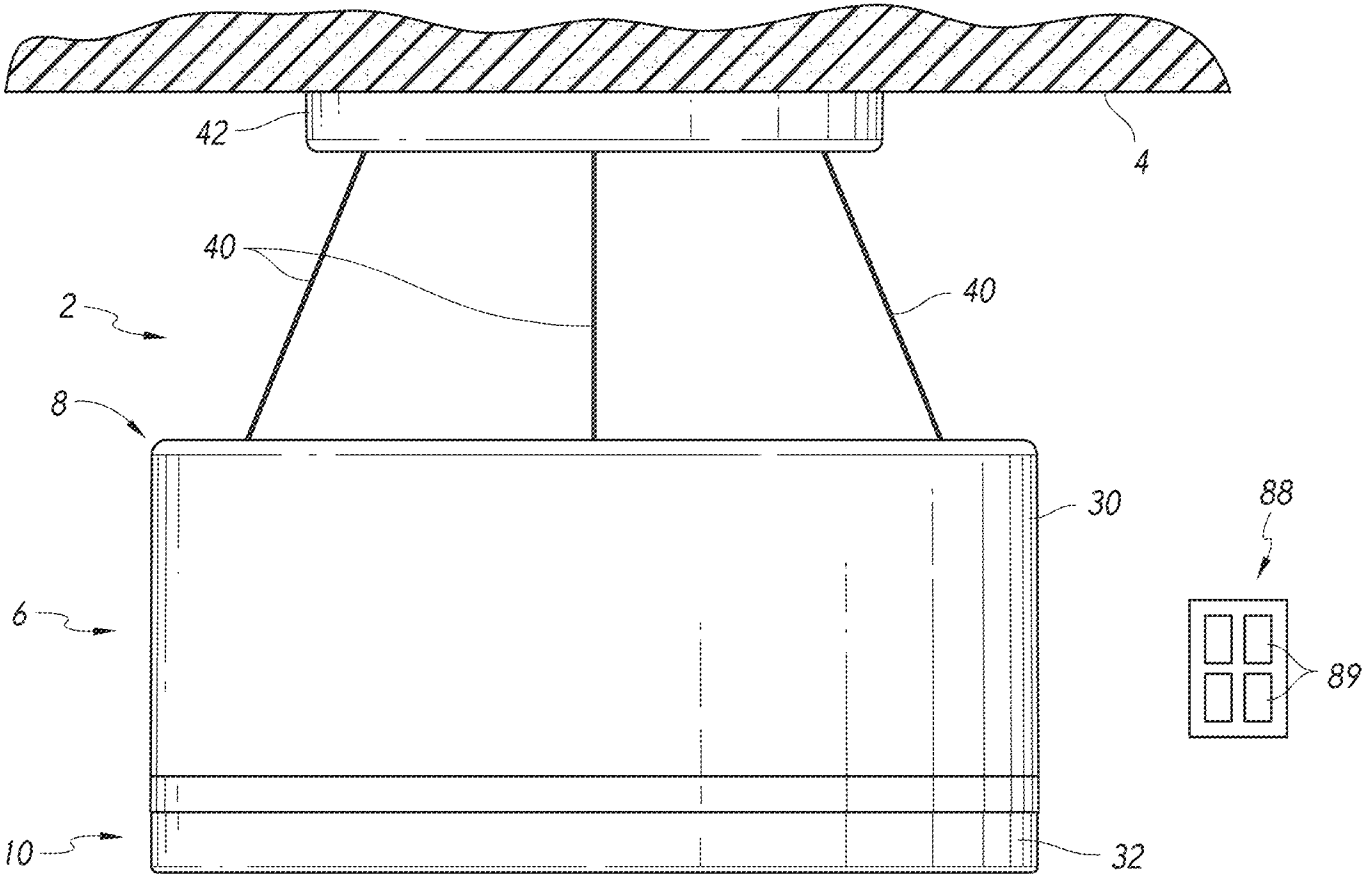
FIG. 3 is a side plan view of the air moving device of FIG. 1.

FIGS. 1 and 3 illustrate an embodiment of an air moving device 2 installed on a ceiling 4. The air moving device 2 can generally include a housing 6 having an upstream end 8 and a downstream end 10. The air moving device 2 can include a housing outlet 12 at or near the downstream end 10 of the housing 6. The housing outlet 12 can include one or more ribs, stators 13, and/or other structures configured to affect airflow through the outlet 12 and/or to provide further structural stability to the outlet of the housing 6. Preferably, the air moving device 2 includes a housing inlet 14 (FIG. 2B) at or near the upstream end 8 of the housing 6.

Figure 2C:
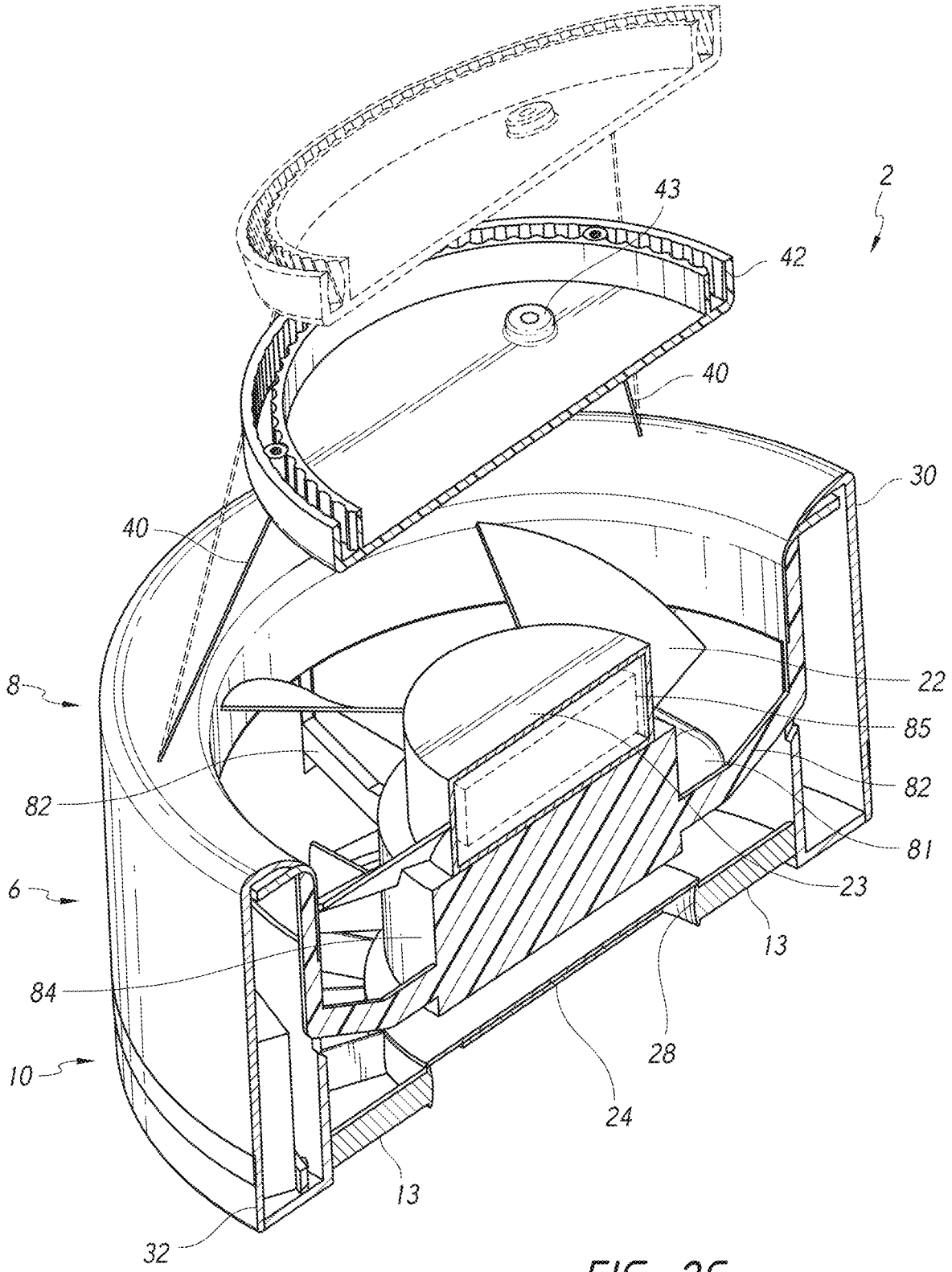
FIG. 2C is perspective cross-sectional view of the air moving device of FIG. 1 viewed along the cut plane 2B-2B of FIG. 2A.

As illustrated in FIGS. 2B-2C, the device 2 can include an impeller 80 mounted partially or entirely within the housing 2. The impeller 80 can include one or more impeller blades 22 connected to an impeller hub 23. The impeller can be configured to pull air into the housing inlet 14 and output air through the housing outlet 12. In some embodiments, the impeller hub 23 is at least partially hollow. An impeller motor (not shown) can be positioned within the impeller hub 23. In some embodiments, the impeller motor is positioned above the impeller hub 23 (e.g., on a side of the impeller hub 23 opposite the outlet 12) or below the impeller hub 23 (e.g., on a side of the impeller hub 23 closest the outlet 12).

In some embodiments, the device 2 includes one or more stator vanes 82. The stator vanes 82 can be positioned between the impeller 80 and the outlet 12 of the housing 6. The stator vanes 82 can be circumferentially distributed about a stator hub 84. In some embodiments, the device includes at least 2, at least 4, at least 5, at least 6, at least 7, and/or at least 8 stator vanes 82. In some embodiments, the device 2 includes a different number of stator vanes 82 than impeller blades 22. Using a different number of stator vanes 82 than impeller blades 22 can reduce noise in the device 2 by reducing invocation of resonate frequencies within the device. The stator vanes 82 can be straight (e.g., planar) or curved (e.g., non-planar). In some embodiments, an upstream portion of one or more stator vanes 82 is curved while a downstream portion of one or more stator vanes 82 is straight. The stator vanes 82 can be configured to straighten air flow from the impeller 80. For example, the stator vanes 82 can transition at least a portion of the swirl (e.g., flow in a circumferential direction) and/or radial flow into axial flow (e.g., flow parallel to an axis of rotation of the impeller 80). Some or all of the flow straightening functions of the stator vanes 82 may also be performed by the stators 13. In some embodiments, the stators 13 have a same shape and/or distribution as the stator vanes 82.

Figure 2D:
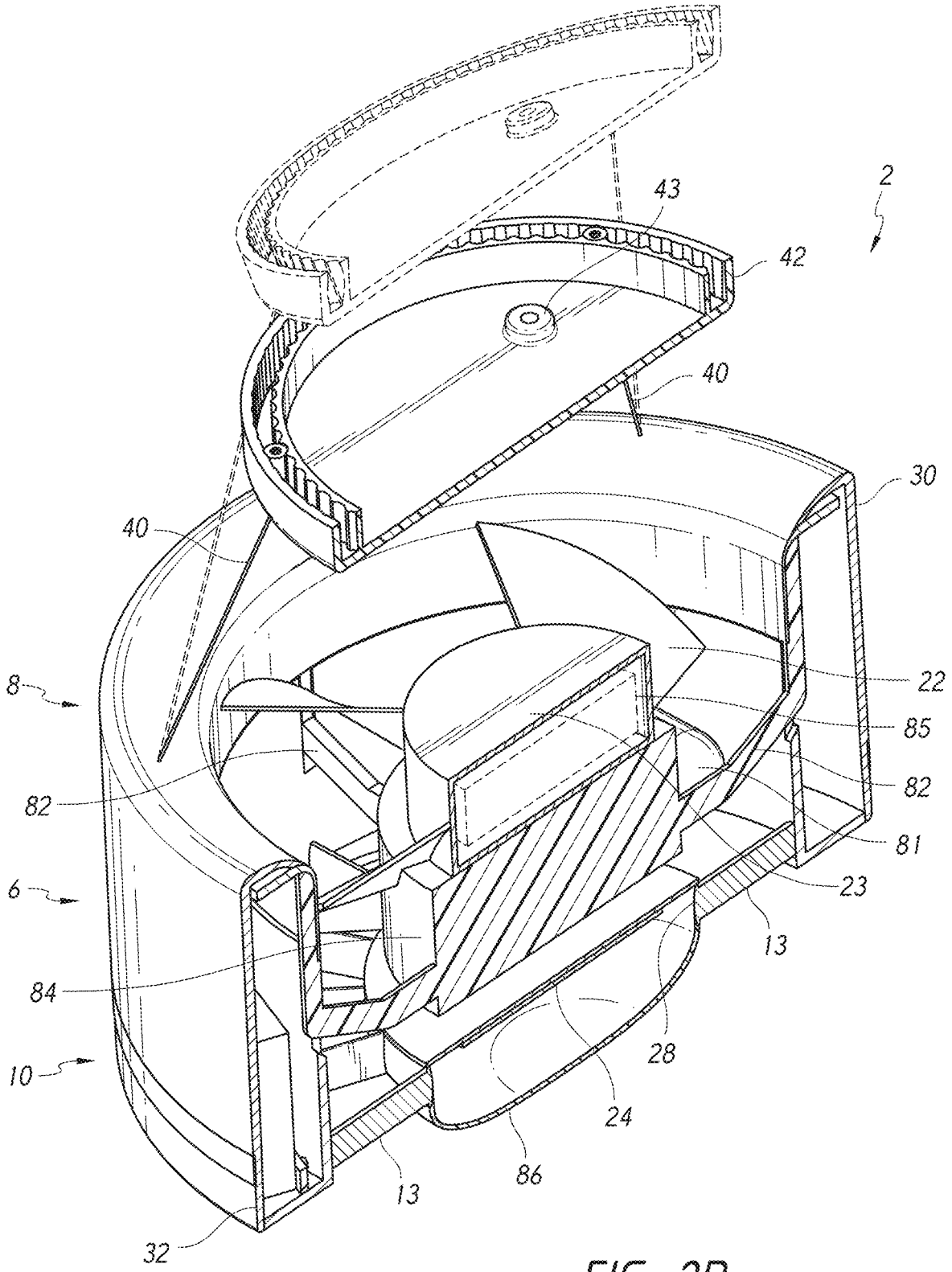
FIG. 2D is a perspective cross-sectional view of the air moving device of FIG. 1 viewed along the cut plane 2B-2B of FIG. 2A, including a dome portion.

As illustrated in FIGS. 2-2D, the air moving device 2 can include a light source 24. The light source 24 can be, for example, an LED, an LED array, a light bulb, and/or some other standard or customized light source. The light source 24 can be positioned at or near the downstream end 10 of the housing 6. In some embodiments, the light source 24 is positioned along an axial centerline CL1 of the housing 6. For example, the light source 24 can be positioned radially inward from the outlet 12 with respect to the axial centerline of the housing 6. The device 2 can include a support, such as support ring 28 or other structure configured to support the light source 24. In some configurations, the support ring 28 defines a radially-inward boundary of the outlet 12 with respect to the axial centerline of the housing 6. Preferably, the light source 24 is positioned such that at least a portion of the air passing through the outlet 12 from the impeller passed over the light source 24 to cool it. As illustrated in FIG. 2B, the light source 24 can be mounted to a plate 83. The plate 83, or another similar structure (e.g., a grill, a dome, a mesh, or some other structure) can be constructed from a conductive material, such as, for example, aluminum. The plate 83 can function as a heat sink for the light source 24, carrying heat from the light source 24 to the surrounding structure and air via conduction and/or convection. As illustrated, the plate 83 can be positioned within the air flow from the impeller 80. Positioning the plate 83 within the air flow path of the impeller 80 can increase the convective heat sink performance of the plate 83.

As illustrated in FIG. 2D, the device 2 can include a dome portion 86 positioned at or near the outlet 12 of the device 2. In some embodiments, the light source 24 is positioned within the dome portion 86. The dome portion 86 can have a hemispherical, frustoconical, and/or some other dome-like shape. The dome portion 86 can be constructed from a polymer, glass, composite, and/or other suitable material. In some embodiments, the dome portion 86 is translucent or transparent. The dome portion 86 can be shaped to diffuse or focus light from the light source 24.

In some embodiments, the air moving device includes a sensor 25 (FIG. 1). The sensor 25 can be configured to sense changes in light, motion, humidity, and/or other parameters. In some embodiments, the sensor 25 is an infrared sensor. The sensor 25 can be positioned at or near the downstream end 10 of the housing 6. In some embodiments, the sensor 25 is configured to control operation of the light source 24 and/or of the impeller 80. In some embodiments, the air moving device 2 includes an air purifier 81 (e.g., an ionizer). The air purifier may be positioned within the dome portion 86 of some embodiments. In some embodiments, as illustrated in FIGS. 2B and 2C, the air purifier 81 is positioned within the housing 6, either inside or outside the air flow path of the air moving device 2. The air moving device 2 can include more than one air purifier 81 positioned in one or more regions of the air moving device 2. The air purifier(s) 81 can be positioned in the air flow path of the air moving device 2 to facilitate distribution of ions or other air purifying substance into the room in which the air moving device 2 is installed. The sensor 25 can be configured to operate the air purifier. One or more of the air purifier 81, the light source 24, and the impeller 80 may be controlled via a remote control 88 (FIG. 3). The remote control 88 can include one or more buttons 89, switches, knobs, levers, and/or other user input structures. In some embodiments, the remote control 88 is sized to be placed on a keychain. The remote control 88 or some other control device (e.g., Bluetooth, RF, Infrared, or other device) can be configured to facilitate functional presets for the air moving device 2. Examples of presets include lighting levels, impeller speeds, air purifier intensity levels, and/or any combination thereof.

Figure 4:
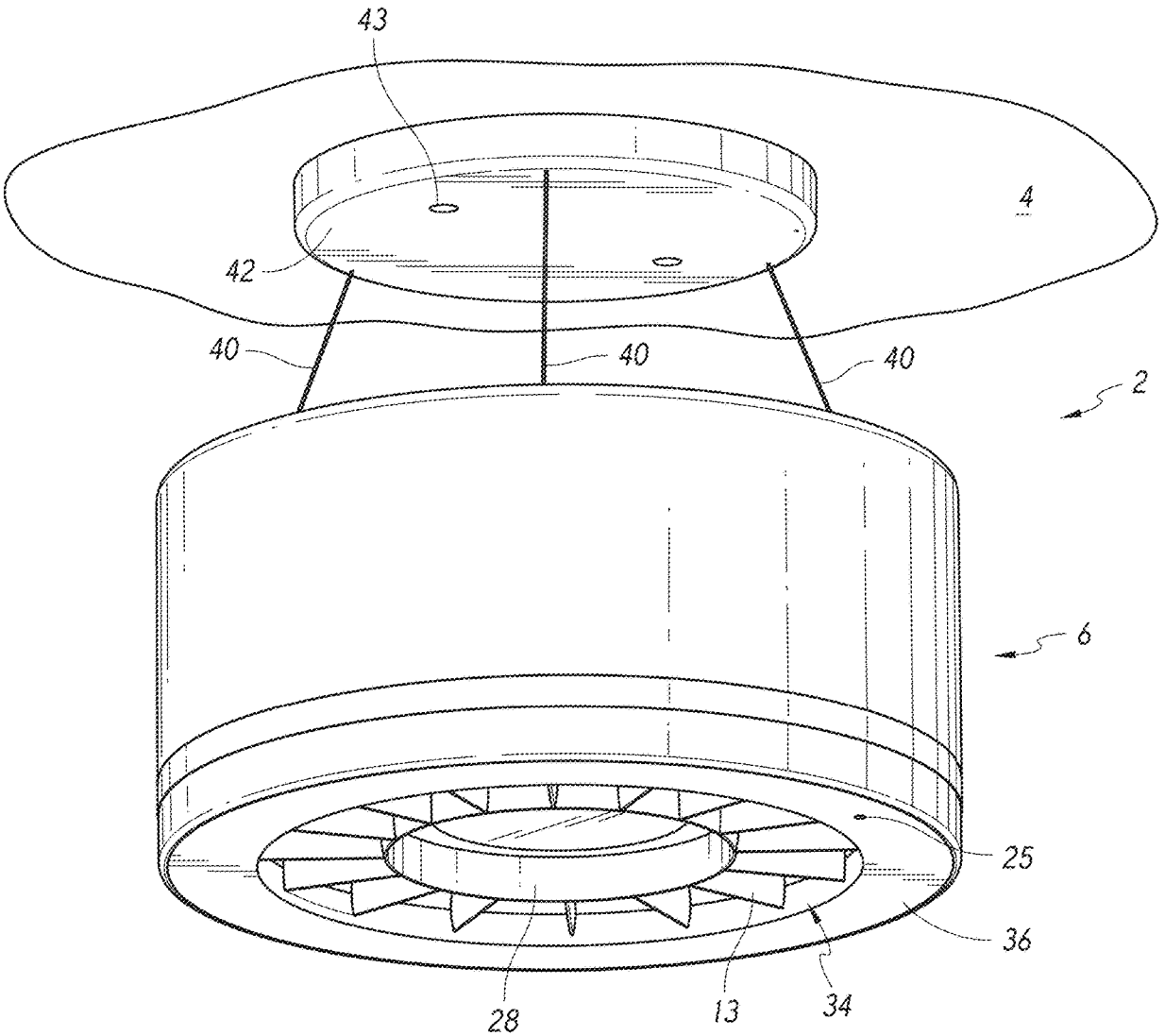
FIG. 4 is another bottom perspective view of the air moving device of FIG. 1.

Referring to FIGS. 3 and 4, the housing 6 can be constructed from a plurality of separate parts. For example, the housing 6 can include an upstream body portion 30 connected to a downstream body portion 32. The upstream and downstream body portions 30, 32 can be configured to couple together via fasteners, friction fit, clips, welding, adhesives, threading, and/or via any other suitable coupling method or structure. In some embodiments, the upstream and downstream portions 30, 32 of the housing 6 are formed as a unitary part.

In some embodiments, the air moving device 2 includes an outlet frame 34. The outlet frame 34 can be coupled with the downstream body portion 32. The outlet frame 34 can include an outer ring 36, the support ring 28 (e.g., an inner ring), and a plurality or ribs or stators 13 connecting the outer ring 36 to the support ring 28. In some embodiments, the outer ring 36 is separate from the outlet frame 34 and/or formed as part of the downstream body portion 32.

As illustrated in FIGS. 3 and 4, the air moving device 2 can be mounted to the ceiling 4 via a plurality of alignment supports, such as tilt members 40. The tilt members 40 can be, for example, wires, chains, strings, and/or any other suitable structure capable of length adjustment and capable of carrying the weight of the air moving device 2. Desirably, the alignment supports are thin, strong and flexible. One end of each tilt member 40 can be connected to the housing 6, and the other end can be connected to a mounting plate 42 (e.g., an installation junction or other installation structure or mechanism). The mounting plate 42 can include one or more attachment structures configured to facilitate attachment of the mounting plate 42 to a ceiling, wall, or other structure. For example, the mounting plate 42 can include one or more apertures 43 configured to receive a fastener. As illustrated, it can be advantageous to have at least three tilt members 40 to facilitate tilting of the air moving device 2 in any desired direction. The scope of the present disclosure, however, includes embodiments having two, four, five, six, or more tilt members 40.

Figure 5:
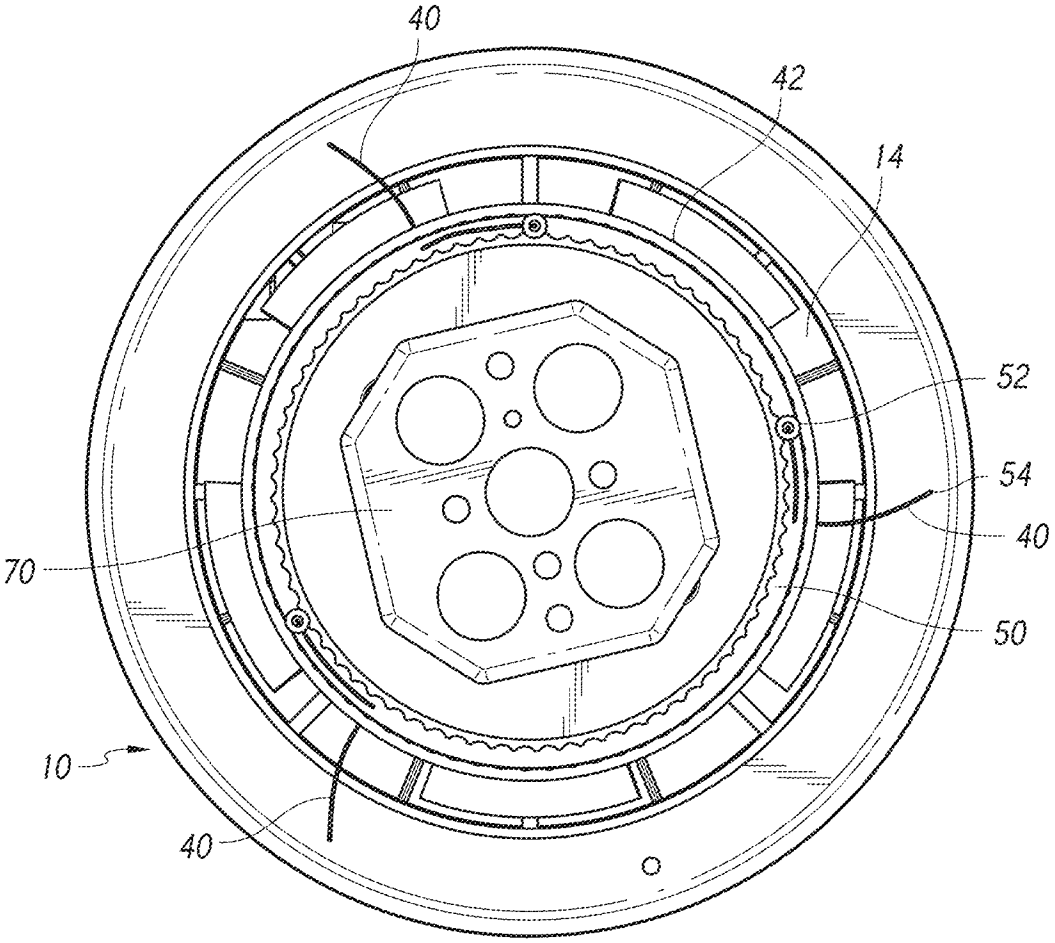
FIG. 5 is a top plan view of the air moving device of FIG. 1.
Figure 6:
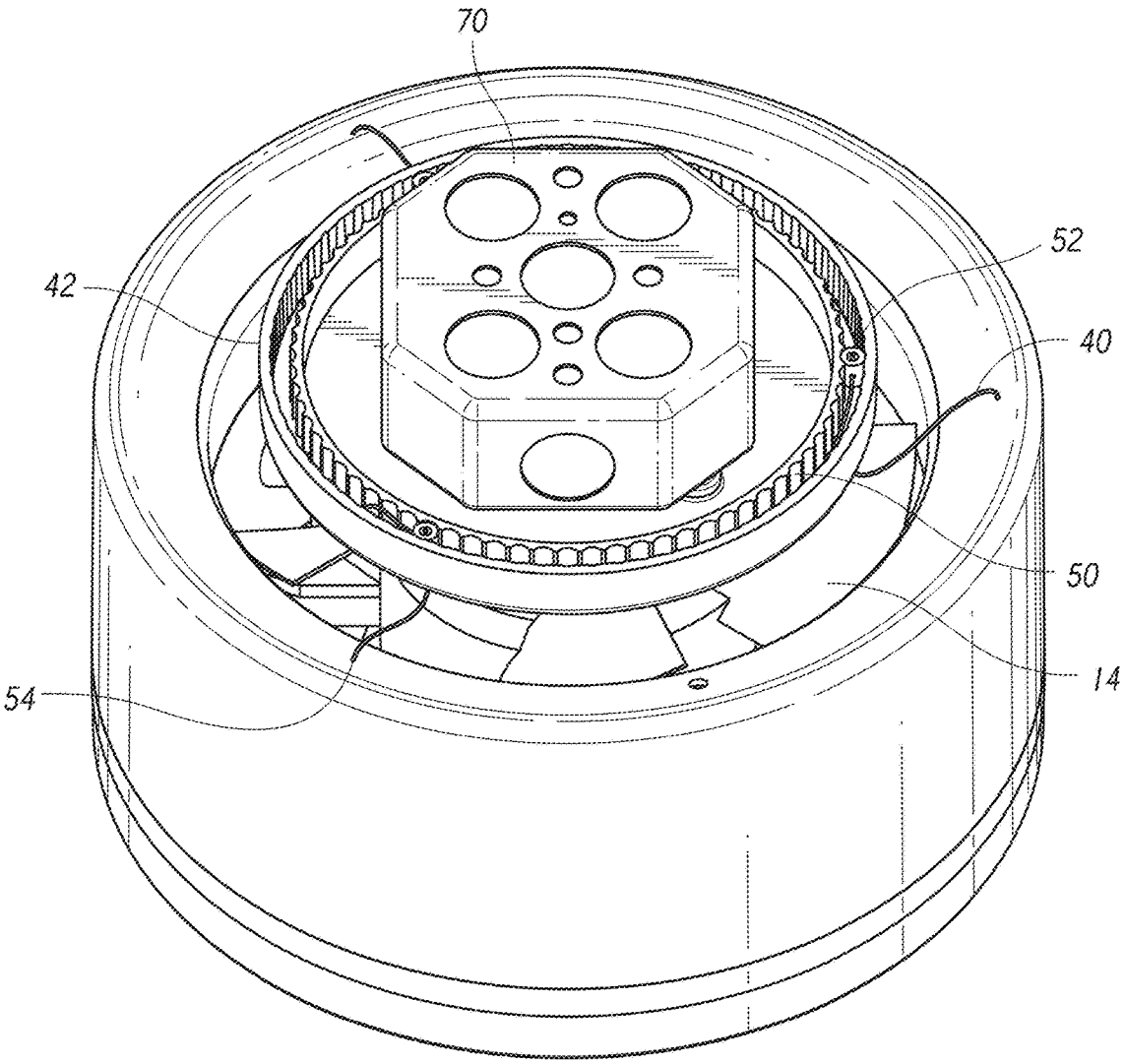
FIG. 6 is a top perspective view of the air moving device of FIG. 1.
Figure 7:
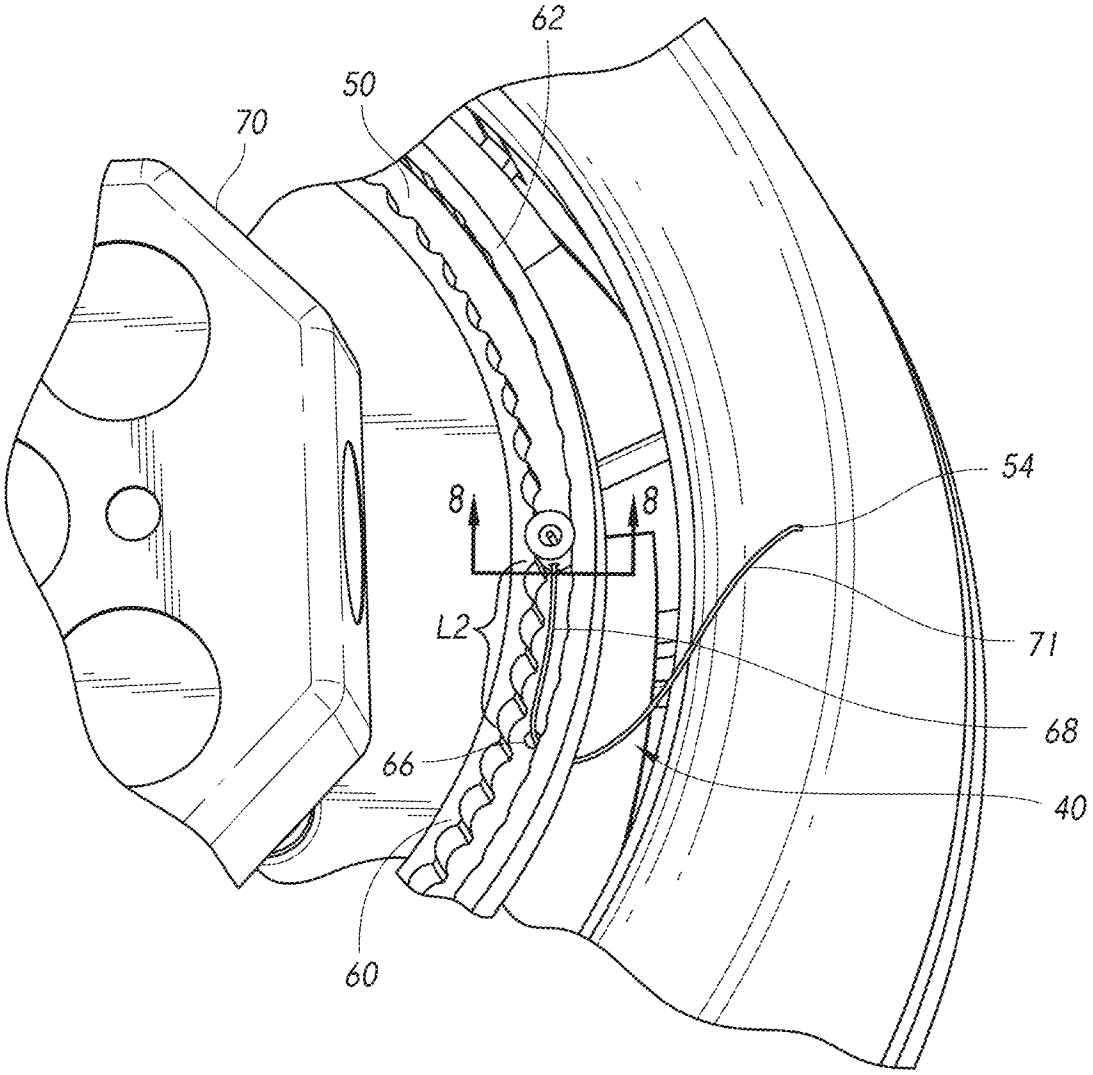
FIG. 7 is a close up top perspective view of the air moving device of FIG. 1.

As best illustrated in FIGS. 5 through 7, the air moving device 2 can include a tilting assembly that comprises the tilting member 40, as well as one or more receiving surfaces, such as tracks formed in one or both of the housing 6 and the mounting plate 42. For example, the tilting assembly can include one or more tracks 50 in the interior of the mounting plate 42. The tracks 50 can be configured to accommodate one end of the tilt members 40. For example, one or more of the tilt members 40 can include an interface or interlock portion, such as anchor 52 on one end. The anchor 52 can be sized and shaped to interact with the track(s) 50. In some embodiments, each of the anchors 52 has a cylindrical or spherical shape. The other end of the tilt members 40 can be connected to the housing via welding, anchoring, clipping, adhering, and/or some other connection mechanism or method. In some embodiments, the ends of the tilt members 40 opposite the anchors 52 extend through apertures 54 in the housing. The tilting mechanism can be positioned between an electrical interface 70 and the housing 6.

Referring to FIG. 7, the track 50 can include scalloping or other shaped features configured to retain the anchors 52 in a fixed position within the track 50. For example, the circumferential track 50 of FIG. 7 includes a first wall 60 positioned radially inward (e.g., with respect to an axial centerline of the mounting plate 42) and opposite a second wall 62. One or both of the first wall 60 and second wall 62 of the track 50 can include ridges and valleys (e.g., scalloping) configured to receive the anchor 52. In some embodiments, the ridges and valleys are more pronounced on the first wall 60 than on the second wall 62. In some embodiments, the ridges and valleys are more pronounced on the second wall 62 than on the first wall 60. The track 50 can be open on a side opposite the housing 6 to permit lifting of the anchors 52 out of the track 50 to alternative positions within the track 50. In some embodiments, the anchors 52 and track 50 interact in a detent-type relationship wherein the anchors 52 can be moved within the track 50 between positions, yet will remain in a specific position within the track 50 when the air moving device 2 is installed. In some embodiments, the track 50 is smooth (e.g., no scalloping or other surface features) and the anchors 52 frictionally engage with the track 50. For example, the anchors 52 may be constructed from a high friction material such as a polymer, rubber, or other suitable material.

Movement of the anchors 52 within the track 50 can facilitate tilting adjustment for the housing 6. For example, as illustrated in FIG. 7, the tilt members 40 can extend through apertures 66 in the mounting plate 42 between the anchors 52 and the housing 6. The tilt member 40 can be divided into a junction portion 68 (e.g., the portion of the tilt member 40 positioned within the track 50 and/or above the mounting plate 42) and a housing portion 71 (e.g., the portion of the tilt member 40 positioned below the mounting plate 42 and/or between the track 50 and the housing 6. The housing portion 71 of the tilt member 40 can have a first length L1 (FIG. 2B) and the junction portion 68 can have a second length L2 (FIG. 7). Movement of the anchor 52 away from the aperture 66 lengthens the junction portion 68 of the tilt member 40 while shortening the length L1 of the housing portion 71 of the tilt member 40. This movement would draw the attachment point (e.g., the aperture 54) between the tilt member 40 and the housing 6 toward the mounting plate 42, raising this attachment point when the air moving device 2 is installed on a ceiling 4. A user of the air moving device 2 can easily customize the tilt of the air moving device 2 by moving the anchors 52 of the tilt members 40 along the track(s) 50 to change the lengths L1 of the various housing portions 71 of the tilt members. Desirably, the track(s) 50 can form guide surfaces to inhibit or prevent the tilt members from tangling or kinking. Examples of various tilt angles are illustrated in FIG. 2B, comparing the mounting plate 42 and tilt members 40 in solid lines to those in phantom.

Figure 8:
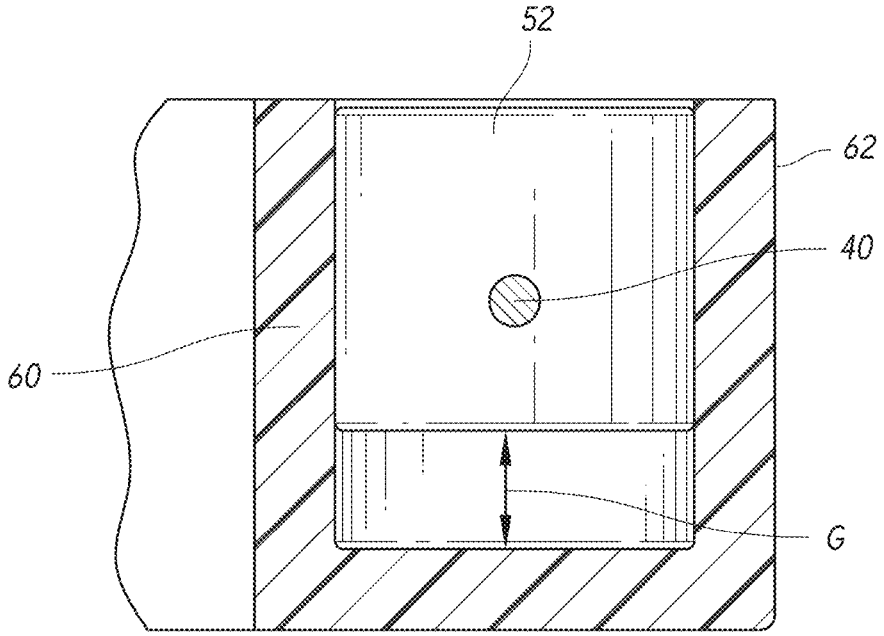
FIG. 8 is a cross-sectional view of a portion of the air moving device of FIG. 1, as viewed along the cut plane 8-8 of FIG. 7.

As illustrated in FIG. 8, a height of the anchors 52 can be less than a depth of the track 50. The difference can form a gap G between the anchors 52 and the bottom of the track 50 when the top of the anchors 52 are aligned with the tops of the first and/or second walls 60, 62 of the track 50. In some embodiments, a user may overlap adjacent anchors 52 such that at least a portion of a tilt member 40 passes by another anchor 52. The gap G can facilitate passing the tilt member 40 under another anchor 52. Passing tilt members 40 under adjacent anchors 52 can reduce the risk of catching loose portions of tilt members 40 on portions of other anchors, the ceiling 40 or other objects.

Figure 9A:
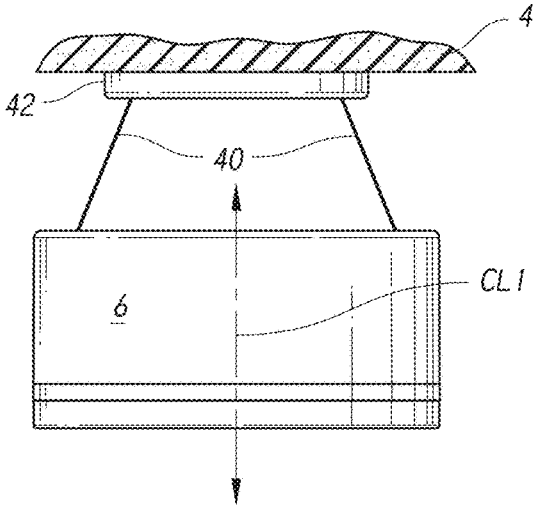
FIG. 9A is a schematic view of an air moving device in a first orientation with respect to a horizontal ceiling.
Figure 9B:
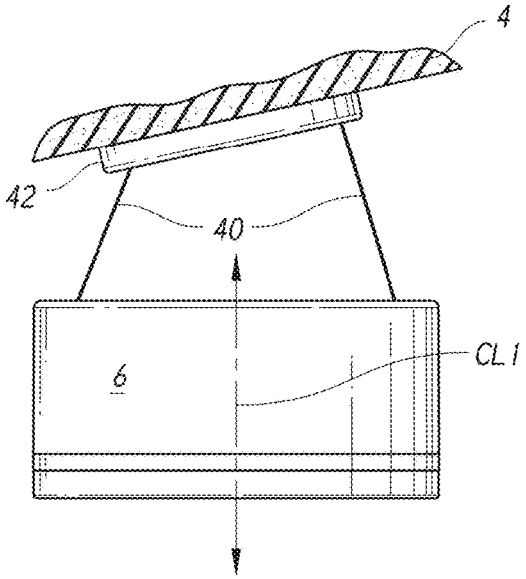
FIG. 9B is a schematic view of an air moving device in a first orientation with respect to a slanted ceiling.
Figure 9C:
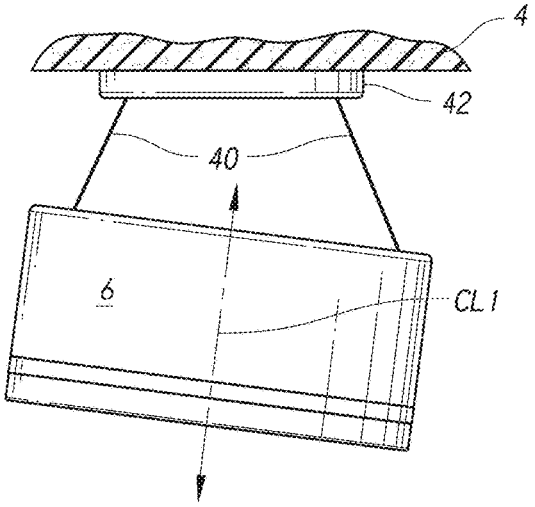
FIG. 9C is a schematic view of an air moving device in a first tilted orientation with respect to a horizontal ceiling.
Figure 9D:
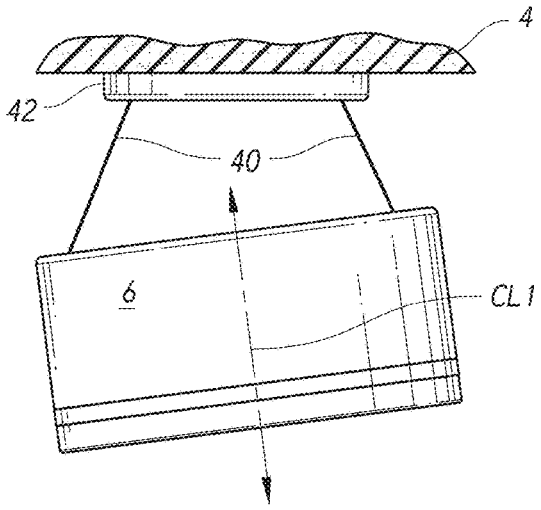
FIG. 9D is a schematic view of an air moving device in a second tilted orientation with respect to a horizontal ceiling.

FIGS. 9A-9D illustrate various device orientations attainable via use of the air moving device 2 disclosed herein. For example, as illustrated in FIG. 1, the device 2 can be configured to orient the housing 6 such that the axial centerline CL1 of the housing 6 is substantially vertical and substantially perpendicular to both the ceiling 4 and the floor. FIG. 9B illustrates an orientation in which the axial centerline CL1 of the housing 6 is vertical, non-perpendicular to the ceiling 4, and substantially perpendicular to the floor. FIGS. 9C and 9D illustrate orientations in which the axial centerline CL1 of the housing 6 is not vertical and non-perpendicular to both the ceiling 4 and the floor. In FIG. 9C, the housing 6 is tilted in a first direction with respect to the ceiling 4, while in FIG. 9D, the housing 6 is tilted in a second direction with respect to the ceiling 4.

For expository purposes, the term "horizontal" as used herein is defined as a plane parallel to the plane or surface of the floor of the area in which the system being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane. In some cases, the term "above" can refer to a position upstream and the term "below" can refer to a position downstream. Upstream and downstream can refer to the direction of flow through the air moving device 10.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

While the preferred embodiments of the present disclosure have been described above, it should be understood that they have been presented by way of example only, and not of limitation. It will be apparent to persons skilled in the relevant art that various changes in form and detail can be made therein without departing from the spirit and scope of the disclosure. For example, the device 2 may include more than one track 50 (e.g., two or more concentric tracks and/or two or more circumferentially-distributed tracks). In some embodiments, the track(s) extend in a non-circumferential direction (e.g., radial). In some configurations, the housing 6 includes a track such that the length of the housing portion of the tilt members 40 can be adjusted by adjusting the connection between the tilt members 40 and the housing 6. Thus the present disclosure should not be limited by the above-described exemplary embodiments, but should be defined only in accordance with the following claims and their equivalents. Furthermore, while certain advantages of the disclosure have been described herein, it is to be understood that not necessarily all such advantages may be achieved in accordance with any particular embodiment of the disclosure. Thus, for example, those skilled in the art will recognize that the disclosure may be embodied or carried out in a manner that achieves or optimizes one advantage or group of advantages as taught herein without necessarily achieving other advantages as may be taught or suggested herein

What is claimed is:

1. A method of mounting an air moving device to an installation site, the method comprising:

attaching first ends of a plurality of flexible connectors to respective first mounting positions of a mount;

attaching second ends of the plurality of flexible connectors to a housing of the air moving device; and attaching the mount to the installation site, wherein the second end of a respective flexible connector of the plurality of flexible connectors is positioned closer to the mount when the first end of the respective flexible connector is in a respective first mounting position of the respective first mounting positions of the mount than when the first end of the respective flexible connector is in a respective second mounting position of the mount.

2. The method of claim 1, wherein attaching the first ends of the plurality of flexible connectors to the respective first mounting positions of the mount comprises releasably engaging anchors on the first ends with indentations in a scalloped wall of the mount.

3. The method of claim 1, further comprising extending each of the plurality of flexible connectors through a respective aperture of a plurality of apertures extending through a lower surface of the mount.

4. The method of claim 1, further comprising extending each of the plurality of flexible connectors through an aperture in the mount.

5. The method of claim 1, wherein the housing includes an upstream end and a downstream end, and the air moving device comprises an impeller positioned at least partially within the housing and configured to direct air into the upstream end and out from the downstream end of the housing.

6. The method of claim 1, further comprising positioning the second end of the respective flexible connector in the respective second mounting position of the mount.

7. The method of claim 1, further comprising attaching the first and seconds such that a first distance from the mount to the housing at a location of a first flexible connector.

8. The method of claim 1, further comprising emitting light from a light source attached to the air moving device.

9. A method of mounting an air moving device, the method comprising:

connecting a plurality of flexible connectors to both the air moving device and a mount, the plurality of flexible connectors configured to support the air moving device;

varying a distance between (1) an intersection of a respective flexible connector of the plurality of flexible connectors and the mount and (2) an intersection of the respective flexible connector and the air moving device; and overlapping one or more flexible connectors of the plurality of flexible connectors with one or more other flexible connectors of the plurality of flexible connectors within a track of the mount.

10. The method of claim 9, further comprising adjusting one or more of the plurality of flexible connectors to tilt the air moving device relative to the mount.

11. The method of claim 9, further comprising emitting light from a light source attached to the air moving device.

12. The method of claim 9, wherein the air moving device comprises a housing having an upstream end and a downstream end, and an impeller positioned at least partially within the housing and configured to direct air into the upstream end and out from the downstream end of the housing.

13. A method of mounting an air moving device, the method comprising:

positioning a first end of a respective flexible connector of a plurality of flexible connectors in a first mounting position of a mount, such that a second opposite end of the respective flexible connector attached to a housing of the air moving device is closer to the mount than when the first end of the respective flexible connector is in a second mounting position of the mount; and attaching the mount to an installation site such that the air moving device is suspended underneath the mount by the plurality of flexible connectors.

14. The method of claim 13, further comprising adjusting one or more of the plurality of flexible connectors to tilt the housing relative to the mount.

15. The method of claim 14, further comprising tilting the housing about a plurality of axes of rotation with respect to the mount.

16. The method of claim 13, further comprising releasably locking an anchor at the first end of the respective flexible connector with the mount.

17. The method of claim 13, further comprising orienting the housing in a plurality of tilted positions without the use of hinges.

18. The method of claim 13, wherein the air moving device comprises a housing having an upstream end and a downstream end, and an impeller positioned at least partially within the housing and configured to direct air into the upstream end and out from the downstream end of the housing.

19. The method of claim 13, further comprising emitting light from a light source attached to the air moving device.

* * * * *